US009133691B2

(12) United States Patent
Rudge

(10) Patent No.: US 9,133,691 B2
(45) Date of Patent: Sep. 15, 2015

(54) LARGE-OFFSET DIRECT VERTICAL ACCESS SYSTEM

(75) Inventor: Daniel Rudge, Nice (FR)

(73) Assignee: Shell Oil Company, Houston, TX (US)

( * ) Notice: Subject to any disclaimer, the term of this patent is extended or adjusted under 35 U.S.C. 154(b) by 590 days.

(21) Appl. No.: 13/280,525

(22) Filed: Oct. 25, 2011

(65) Prior Publication Data

US 2012/0103624 A1 May 3, 2012

Related U.S. Application Data

(60) Provisional application No. 61/407,260, filed on Oct. 27, 2010.

(51) Int. Cl.
*E21B 7/12* (2006.01)
*E21B 43/01* (2006.01)
*E21B 43/017* (2006.01)

(52) U.S. Cl.
CPC ..... *E21B 43/01* (2013.01); *E21B 43/017* (2013.01)

(58) Field of Classification Search
CPC ..... E21B 7/128; E21B 43/017
USPC ..... 166/352, 358, 366; 175/7
See application file for complete search history.

(56) References Cited

U.S. PATENT DOCUMENTS 3,419,090 A * 12/1968 Van Dorn ..... 175/7
3,572,278 A * 3/1971 Knapp et al. ..... 14/263
4,138,751 A * 2/1979 Kentosh ..... 441/5
4,182,584 A * 1/1980 Panicker et al. ..... 405/224.3
4,478,586 A * 10/1984 Gentry et al. ..... 441/4
4,643,614 A * 2/1987 Laursen ..... 405/169
4,648,848 A * 3/1987 Busch ..... 441/5
4,735,267 A * 4/1988 Stevens ..... 166/345
4,972,907 A * 11/1990 Sellars, Jr. ..... 166/353
5,330,293 A * 7/1994 White et al. ..... 405/211
5,342,148 A * 8/1994 Huete et al. ..... 405/223.1
5,486,070 A * 1/1996 Huete ..... 405/202
5,567,086 A * 10/1996 Huete ..... 405/223.1
5,590,982 A * 1/1997 Huete ..... 405/223.1
6,082,391 A * 7/2000 Thiebaud et al. ..... 137/236.1
6,135,673 A * 10/2000 Horton et al. ..... 405/205
6,227,137 B1 * 5/2001 Allen et al. ..... 114/264
6,725,936 B2 * 4/2004 Hopper ..... 166/366
6,752,214 B2 * 6/2004 Amin et al. ..... 166/369
6,893,190 B2 * 5/2005 Macrea et al. ..... 405/209
7,008,141 B2 * 3/2006 Fitzgerald et al. ..... 405/224.2
7,073,593 B2 * 7/2006 Hatton et al. ..... 166/367
7,703,535 B2 * 4/2010 Benson ..... 166/368
7,793,724 B2 * 9/2010 Daniel et al. ..... 166/366
7,958,938 B2 * 6/2011 Crossley et al. ..... 166/366
8,657,012 B2 * 2/2014 Fenton et al. ..... 166/345
2001/0013414 A1 * 8/2001 Fitzgerald et al. ..... 166/366
2004/0244986 A1 * 12/2004 Poldervaart et al. ..... 166/367
2005/0178556 A1 * 8/2005 Appleford et al. ..... 166/366

(Continued)

FOREIGN PATENT DOCUMENTS

WO WO2009148943 12/2009 ..... E21B 7/128
WO WO2011059918 5/2011 ..... B63B 21/50

*Primary Examiner* — Matthew Buck
*Assistant Examiner* — Aaron Lembo

(57) ABSTRACT

A system comprising a floating host located over a first drilling center in a body of water, the floating host comprising drilling facilities; a floating spar located over a second drilling center; a first fluid transfer conduit between the second drilling center and the spar; and a second fluid transfer conduit between the spar and the floating host.

12 Claims, 6 Drawing Sheets

(56) References Cited

U.S. PATENT DOCUMENTS

2006/0000615 A1* 1/2006 Choi ..... 166/352
2009/0314495 A1 12/2009 Schott, III et al. ..... 166/366
2011/0132615 A1* 6/2011 Gonzalez et al. ..... 166/366
2013/0319681 A1* 12/2013 Wald et al. ..... 166/366

* cited by examiner

LARGE-OFFSET DIRECT VERTICAL ACCESS SYSTEM

PRIORITY CLAIM

This application claims priority from U.S. provisional patent application 61/407,260, filed on Oct. 27, 2010, which is herein incorporated by reference.

FIELD OF THE INVENTION

The application is directed to subsea oil and gas drilling and production systems.

BACKGROUND OF THE INVENTION

United States Patent Application Publication Number 2009/0314495 discloses a system comprising a mobile offshore drilling unit, a first group of wells drilled by the mobile offshore drilling unit, a second group of wells drilled by the mobile offshore drilling unit, wherein the mobile offshore drilling unit comprises processing equipment adapted to process production from the first group of wells and the second group of wells. United States Patent Application Publication Number 2009/0314495 is herein incorporated by reference in its entirety.

PCT Patent Application Publication Number WO 2009/148943 discloses a method of drilling and producing from an offshore structure, comprising drilling a first well from the offshore structure with a drilling riser; completing the first well with a first subsurface tree; connecting the first subsurface tree to a manifold; drilling a second well from the offshore structure with a drilling riser; completing the second well with a second subsurface tree; connecting the second subsurface tree to the manifold; and connecting a production riser to the manifold and the offshore structure. PCT Patent Application Publication Number WO 2009/148943 is herein incorporated by reference in its entirety.

PCT Patent Application Publication Number WO 2011/059918 discloses a floating offshore system in a body of water, comprising a floating structure; a bearing attached about a circumference of the floating structure; at least one anchor connected to a bottom of the body of water; a line connected to the anchor and the floating structure; a floating vessel adjacent to the floating structure; and a yoke connecting the floating vessel and connected to the bearing; wherein the bearing and yoke provide for relative motion between the floating structure and floating vessel, such that the floating vessel can rotate about a circumference of the floating structure and move independently, vertically (up and down) relative to the floating structure in response to varying operational and environmental loads. PCT Patent Application Publication Number WO 2011/059918 is herein incorporated by reference in its entirety.

SUMMARY OF THE INVENTION

One aspect of the invention provides a system comprising a floating host located over a first drilling center in a body of water, the floating host comprising drilling facilities; a floating spar located over a second drilling center; a first fluid transfer conduit between the second drilling center and the spar; and a second fluid transfer conduit between the spar and the floating host.

Another aspect of the invention provides a method comprising drilling a first group of subsea wells at a first location from a floating host; moving the floating host to a second location and drilling a second group of subsea wells; connecting the first group to a floating spar in the first location; and connecting the floating spar to the floating host with a fluid conduit.

DETAILED DESCRIPTION

In one aspect, embodiments disclosed herein relate to a direct vertical access ("DVA") system capable of servicing multiple subsea drilling centers. The DVA system permits direct vertical access over one or more subsea wells or drilling centers that may be some distance apart (potentially several miles apart). In particular, the DVA system is capable of providing direct vertical access to multiple wells from a fixed drilling and production center.

Conventional subsea developments may require the wells to be drilled and completed using a semi-submersible drilling rig or drillship, which travels to each well site individually. Recently, the day rate of typical deep water semi-submersible drilling rigs and drillships has increased and driven up development costs, which have thereby reduced the economic viability of potential developments. The DVA system disclosed herein permits direct vertical access over one or more subsea wells and/or drilling centers that may be some distance (potentially several kilometers) apart. The DVA system provides a central location around which the multiple subsea wells or drilling centers may be located. Thus, embodiments disclosed herein provides drilling and production capabilities from one centrally located drilling and production center rather than moving the drilling and production center to each of the multiple locations for the subsea wells.

Figure 1A:
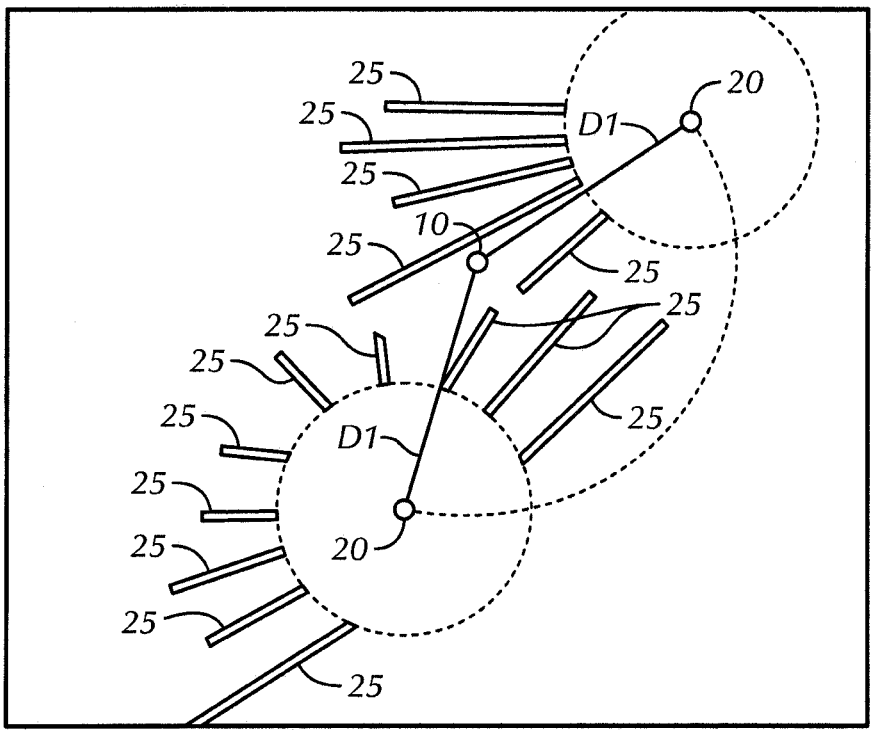
FIG. 1A shows a layout view of fixed radius offset drill centers in accordance with embodiments of the present disclosure.
Figure 1B:
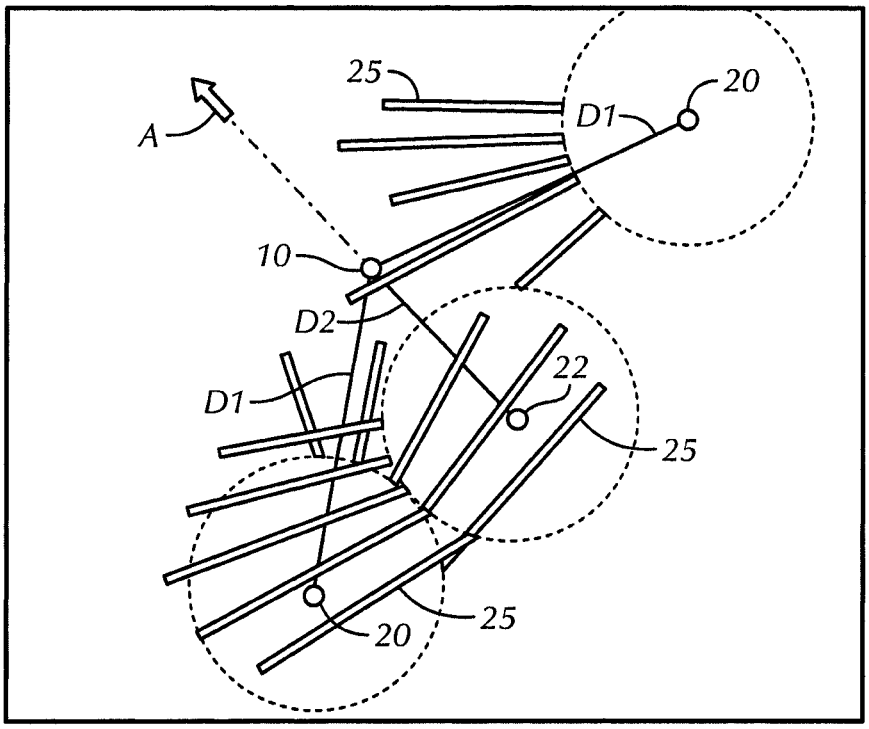
FIG. 1B shows a layout view of variable radius offset drill centers in accordance with embodiments of the present disclosure.

FIGS. 1A & 1B:

Referring to FIGS. 1A and 1B, layout views of drilling and production center arrangements in a given field are shown in accordance with embodiments of the present disclosure. FIG. 1A shows a centrally located riser tower 10 about which two drill and production centers 20 are located. Multiple horizontal wells 25 are located at distances from the drill centers 20. As shown, the drill centers 20 are located at equal distances D1 from the riser tower 10. The arrangement shown in FIG. 1A has the drill centers 20 at a fixed radius offset. The fixed offset of the drill centers 20 from the riser tower 10 may range from between 1,000 to 1,500 meters (e.g., both drill centers 20 at a distance of 1,200 meters from riser tower 10), or greater in certain embodiments.

FIG. 1B shows a centrally located riser tower 10 about which multiple drill centers 20, 22 are located. Multiple horizontal wells 25 are located at distances from the drill centers 20, 22. FIG. 1B has the drill centers 20 at a distance D1 from the riser tower 10, and drill center 22 at a distance D2 from the riser tower 10, or a variable radius offset. The variable radius offset of the drill centers 20, 22 from the riser tower may range from between 800 and 1,600 meters (e.g., drill centers 20 at a distance of 1,600 meters from riser tower 10 and drill center 22 at a distance of 800 meters from riser tower 10). In alternate embodiments, all three drill centers may be at three different distances from the riser tower. Outward movement (indicated by arrow A) of the riser tower 10 may increase a mean (average) offset of the drill centers 20, 22 (i.e., an average distance of all drill centers from the riser tower is greater), but would reduce the variable offset component (i.e., there is less variation in the distances of different drill centers from the riser tower).

Figure 2A:
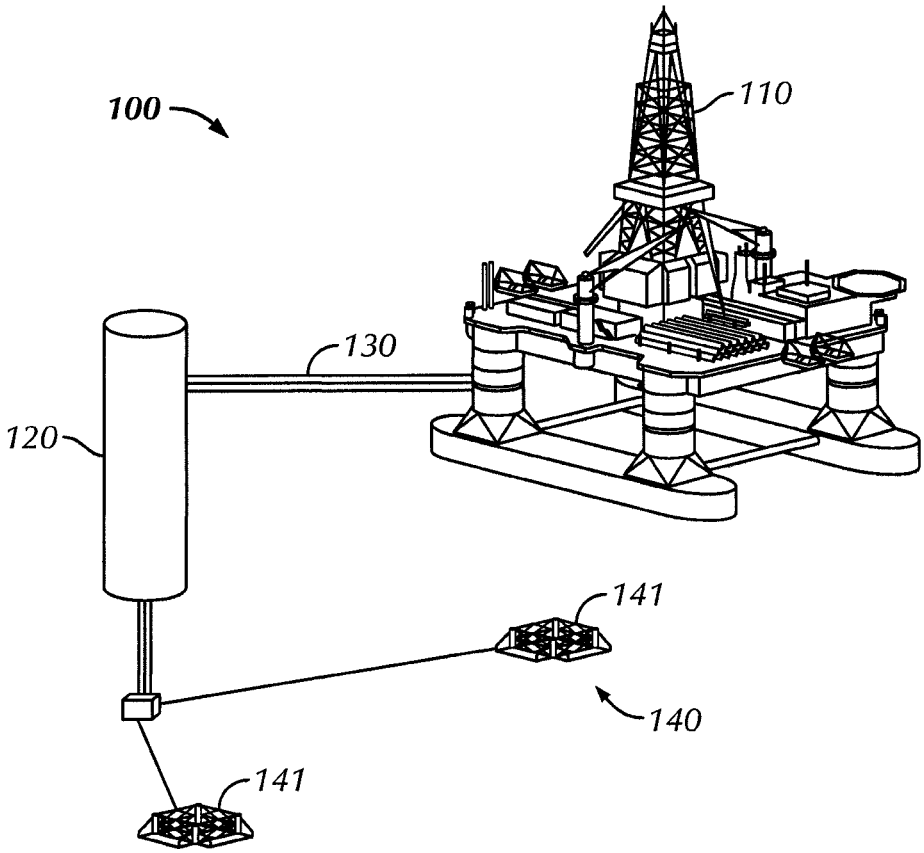
FIGS. 2A and 2B are perspective views of a direct vertical access system in accordance with embodiments of the present disclosure.
Figure 2B:
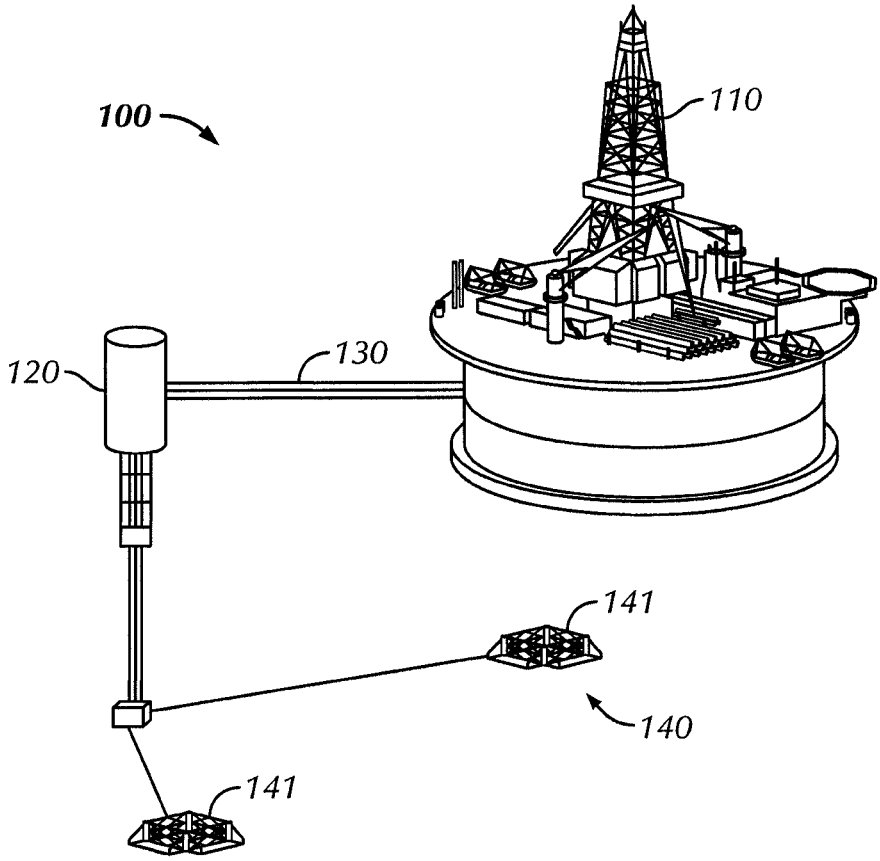

FIGS. 2A & 2B:

Referring now to FIGS. 2A and 2B, perspective views of a direct vertical access system 100 are shown in accordance with embodiments of the present disclosure. The DVA system includes a detachable floating drilling and production host 110, a riser tower 120 or a spar (e.g., S-SPAR) floating at the water surface, and a fluid transfer system 130, which provides communication between drilling and production host 110 and riser tower 120. As shown, the riser tower 120 services a subsea development 140, which may include multiple drilling and production centers 141 arranged on the seafloor so as to provide sufficient surface coverage and drainage of a target reservoir (as shown in FIGS. 1A and 1B).

Figure 3:
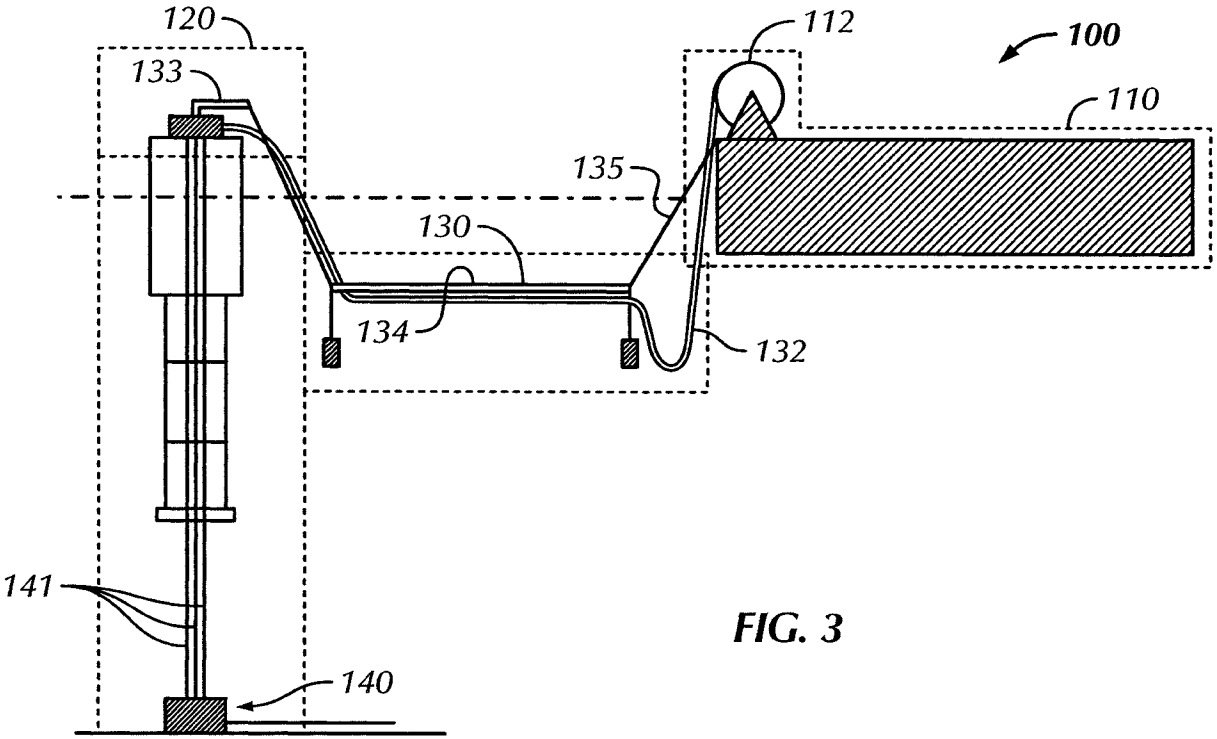
FIG. 3 is a plan view of the direct vertical access system in accordance with embodiments of the present disclosure.

FIG. 3:

Referring now to FIG. 3, a plan view of the DVA system 100 is shown in accordance with embodiments of the present disclosure. The floating drilling and production host 110 may be configured as a semi-submersible, spar structure, floating, drilling, production, storage, and offloading vessel ("FDPSO"), or any other structure known to those skilled in the art. For example, in certain embodiments, a FDPSO, like a Sevan FDPSO manufactured and sold by the Norwegian company Sevan Marine ASA, may be used as the central drilling and production center, as shown in FIG. 2B. The drilling and production host 110 of the disclosed embodiments may include storage and offloading capabilities for hydrocarbons that have been produced from the wells and transported to the drilling and production host 110. Typically, the drilling and production host 110 may store the produced hydrocarbons until a sufficient quantity has been produced, at which time the produced hydrocarbons may be loaded onto a tanker or pumped through a pipeline to onshore facilities. The drilling and production host 110 may be disconnected from the riser tower 120 to service multiple riser towers in a given area.

The riser tower 120 is configured to incorporate multiple production risers 141 from subsea developments 140 into a single unit and transfer fluids from the risers 141 to the drilling and production host 110. Riser towers are provided for conveying production fluids from a well at the seafloor to the surface, and for conveying lifting gas, injection water and treatment chemicals such as methanol from the surface to the seabed. A foot of each riser may be connected to a number of well heads/injection sites by horizontal pipelines. Further pipelines may link to other well sites at a remote part of the seabed. At the sea surface, the top of each riser tower may be supported by a buoy (not shown) for floatation. The riser towers may be prefabricated at shore facilities, towed to their operating location and then installed to the seabed with anchors at the bottom and buoyancy at the top.

The riser tower 120 may have storage capabilities, for example, machinery storage and/or fluid storage (e.g., chemicals, diesel). The storage capabilities of the riser tower 120 may allow flushing of the risers and subsea flowlines without pumping diesel from the drilling and production host 110. In the instance where the drilling and production host 110 storage capabilities are not consumed with other fluids, the riser tower 120 may be able to store produced hydrocarbons until they can be offloaded to ships or piped to an onshore facility.

Further, a fluid transfer system 130 may be disposed between the riser tower 120 and the drilling and production host 110. Fluid transfer system 130 may include an arm 133, which is mounted on top of the riser tower 120. The arm 133 may be a fixed, rotating, or swinging arm depending on, for example, the size of the riser tower 120, and/or the space available. In certain embodiments, arm 133 may rotate a full 360 degrees about the riser tower 120, which allows the drilling and production host 110 to rotate around the riser tower 120.

The fluid transfer system 130 includes a gravity actuated pipe ("GAP") 134, which is a neutrally buoyant pipeline bundle. GAP 134 may be attached to and supported by a cable 135 deployed from reel 112 on the host 110. GAP 134 may be used to control a depth in the water at which the entire fluid transfer system 130 is located. For example, optimal fluid transfer between the riser tower 120 and the drilling and production host 110 may occur at a specified depth below the water surface. For example, GAP 134 may be capable of deploying the fluid transfer system below an active wave zone, for example from about 50 to about 150 feet, which may be optimal to prevent damage to the fluid transfer system 130 by wave action. Additionally, the neutrally buoyant configuration of GAP 134 may be able to withstand and support some loads experienced on the host structures, i.e., drilling and production host 110 and riser tower 120.

Fluid transfer system 130 also includes a flexible flowline 132 deployed from the host 110 through which the transferred fluid may flow between the riser tower 120 and the host 110. Flexible jumpers (not shown) may be used to connect the riser flowlines 141 in the riser tower 120 with the flexible flowline 132 of the fluid transfer system. The flexible jumpers eliminate the need for complex fluid swivels given limited variable angular offset of the host 110 from the riser tower 120 (i.e., the host 110 is so close to the riser tower 120 that a severe bend would be needed in the fluid path, which could impede fluid flow).

Figure 4A:
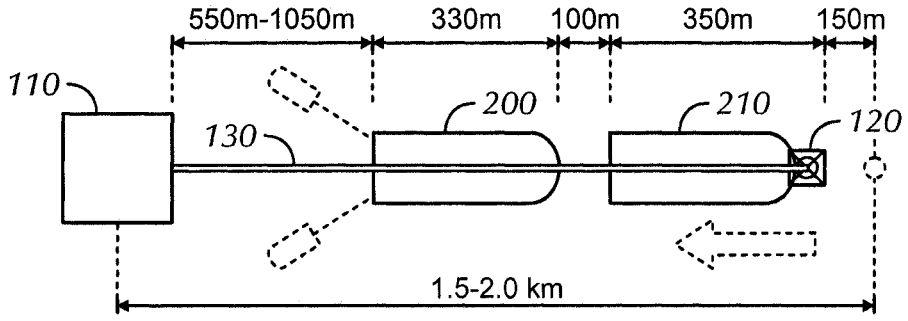
FIGS. 4A and 4B are layout views of the direct vertical access system when offloading produced hydrocarbons in accordance with embodiments of the present disclosure.
Figure 4B:
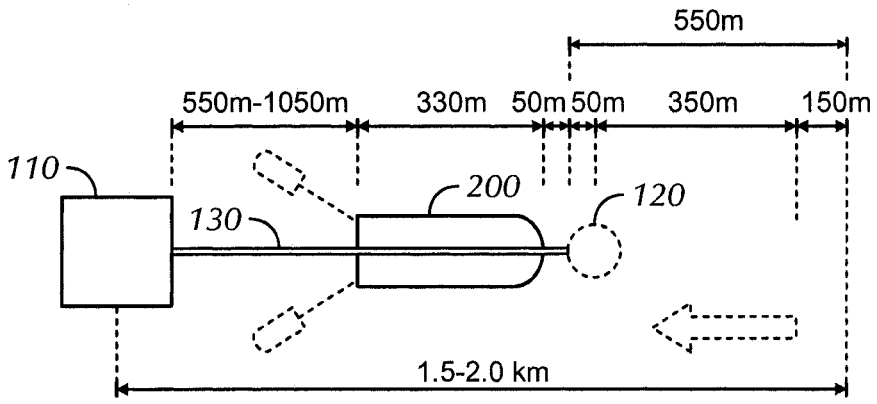

FIGS. 4A & 4B:

Referring now to FIGS. 4A and 4B, layout views of example configurations of the DVA system for offloading produced hydrocarbons are shown in accordance with embodiments of the present disclosure. FIG. 4A shows a DVA host 110 connected to a riser tower 120 and in fluid communication through a fluid transfer system 130. A turret moored floating production, storage and offloading ("FPSO") unit 210 may be interconnected between the host 110 and the riser tower 120. The FPSO vessel is designed to receive oil or gas produced from nearby platforms or subsea template, process it, and store it until the oil or gas can be offloaded onto a tanker 200 or transported through a pipeline. The FPSO may improve vessel motion with currents, reduce mooring design loads, and facilitate tandem offloading (i.e., transferring produced fluid from the riser tower 120 to both the host 110 and a tanker 200).

FIG. 4B shows a DVA host 110 fluidly connected by a fluid transfer system 130 to a riser tower 120, which in this embodiment may be an S-SPAR. A tanker 200 is also connected to the fluid transfer system 130. The S-SPAR configuration, which also serves as a storage unit and thus eliminates the need for an FPSO, reduces the length of the fluid transfer line 130 (up to 500 m) without imposing any additional operating restrictions on the tanker 200.

Advantageously, embodiments of the present disclosure provide a DVA system that may provide lower cost drilling, completion and lifecycle workover costs as compared to typical subsea development that requires a semi-submersible drilling rig or drillship to perform the same tasks. The integral drilling and completion capability and mobility of the DVA system addresses each of these problems, providing low cost (comparable with other fixed deepwater development systems) drilling and completion functionality and the potential ability to relocate from one drill center or well to another without a production shutdown. Further, where seabed pumping or other artificial lift systems are installed to combat the higher back pressures and the subsequent production loss inherent in a typical subsea development, the DVA system provides the capability to intervene and replace subsea pumps, modules and the like without the need to mobilize specialized vessels to the field, thereby minimizing the associated production deferment and costs. The system is flexible and may incorporate in-well, seabed, and riser based artificial lift and flow assurance technologies so as to maximize recovery of reserves over the field life. The DVA system of the present disclosure may be deployed in water depths ranging from 100 meters to greater than 2,000 meters.

Illustrative Embodiments

In one embodiment, there is disclosed a system comprising a floating host located over a first drilling center in a body of water, the floating host comprising drilling facilities; a floating spar located over a second drilling center; a first fluid transfer conduit between the second drilling center and the spar; and a second fluid transfer conduit between the spar and the floating host. In some embodiments, the system also includes a third fluid transfer conduit between the first drilling center and the second drilling center. In some embodiments, the system also includes a fourth fluid transfer conduit between the first drilling center and the host. In some embodiments, the system also includes an offset between the host and the spar comprising a distance from 500 to 2000 meters. In some embodiments, the body of water comprises a water depth from 500 to 5000 meters. In some embodiments, the second fluid transfer conduit comprises a pipe at least partially submerged in the body of water. In some embodiments, the pipe is neutrally buoyant. In some embodiments, the system also includes ballast connected to the pipe. In some embodiments, the system also includes a cable connected at one end to a reel located on the host, and at the other end to the submerged pipe. In some embodiments, the system also includes a tanker connected to the second fluid transfer conduit. In some embodiments, the system also includes an FPSO connected to the second fluid transfer conduit. In some embodiments, the system also includes a tanker connected to the FPSO. In some embodiments, the spar further comprises a swivel, the swivel connected to the second fluid transfer conduit.

In one embodiment, there is disclosed a method comprising drilling a first group of subsea wells at a first location from a floating host; moving the floating host to a second location and drilling a second group of subsea wells; connecting the first group to a floating spar in the first location; and connecting the floating spar to the floating host with a fluid conduit. In some embodiments, the method also includes connecting the second group of wells to the first group of wells. In some embodiments, the first location is at a distance of from 1000 to 4000 meters from the second location. In some embodiments, the method also includes submerging at least a portion of the fluid conduit. In some embodiments, the method also includes submerging at least a portion of the fluid conduit to a depth from 25 to 100 meters.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A subsea direct vertical access system, comprising:

a floating host located over a first drilling center in a body of water, the floating host comprising drilling facilities;

a riser tower located over a second drilling center;

a fluid transfer system between the riser tower and the floating host, wherein the fluid transfer system comprises an arm mounted on top of the riser tower; a gravity actuated pipe; and a flexible flow line, wherein the arm is able to rotate a full 360 degrees about the riser tower, wherein the floating host is able to rotate around the riser tower, and wherein the fluid transfer system permits fluid transfer between the riser tower and the floating host; and a first fluid transfer conduit between the second drilling center and the riser tower.

2. The system of claim 1, further comprising a second fluid transfer conduit between the first drilling center and the second drilling center.

3. The system of claim 1, further comprising a third fluid transfer conduit between the first drilling center and the host.

4. The system claim 1, further comprising an offset between the host and the riser tower comprising a distance from 500 to 2000 meters.

5. The system of claim 1, wherein the body of water comprises a water depth from 500 to 5000 meters.

6. The system of claim 1, further comprising a cable connected at one end to a reel located on the host.

7. The system of claim 1, further comprising a tanker connected to the fluid transfer system.

8. The system of claim 1, further comprising an FPSO connected to the fluid transfer system.

9. The system of claim 8, further comprising a tanker connected to the FPSO.

10. A method comprising:

drilling a first group of subsea wells at a first location from a floating host;

moving the floating host to a second location and drilling a second group of subsea wells;

connecting the first group to a riser tower in the first location; and connecting the riser tower to the floating host with a fluid transfer system, wherein the fluid transfer system comprises an arm mounted on top of the riser tower; a gravity actuated pipe; and a flexible flow line, wherein the arm is able to rotate a full 360 degrees about the riser tower, wherein the floating host is able to rotate around the riser tower, and wherein the fluid transfer system permits fluid transfer between the riser tower and the floating host.

11. The method of claim 10, further comprising connecting the second group of wells to the first group of wells.

12. The method of claim 10, wherein the first location is at a distance of from 1000 to 4000 meters from the second location.

* * * * *